US005829521A

United States Patent [19]

Brown, Jr.

[11] Patent Number: 5,829,521

[45] Date of Patent: Nov. 3, 1998

[54] DOWN HOLE CLEANING DEVICE AND METHOD

[76] Inventor: Billy L. Brown, Jr., 3406 Oakland Dr., Sugar Land, Tex. 77479

[21] Appl. No.: 804,216

[22] Filed: Feb. 21, 1997

[51] Int. Cl.[6] ..... F21B 37/00; B08B 9/02

[52] U.S. Cl. ..... 166/173; 15/104.2

[58] Field of Search ..... 166/170, 172, 166/173, 174, 176; 15/104.05, 104.16, 104.2

[56] References Cited

U.S. PATENT DOCUMENTS

| | | | |
|---|---|---|---|
| 2,682,069 | 6/1954 | Scriminger | 15/104.2 X |
| 3,032,114 | 5/1962 | Best | 166/173 |
| 3,824,646 | 7/1974 | Jai | 15/104.2 X |
| 3,827,492 | 8/1974 | Hammon et al. | 166/173 |
| 4,438,812 | 3/1984 | Hammon | 166/173 |
| 4,501,322 | 2/1985 | Martin | 166/173 |
| 4,503,578 | 3/1985 | McIntyre | 15/104.2 X |
| 5,419,397 | 5/1995 | Reynolds | 166/312 |
| 5,711,046 | 1/1998 | Potter | 166/173 X |

*Primary Examiner*—David J. Bagnell

*Attorney, Agent, or Firm*—Domingue, Delaune & Waddell

[57] ABSTRACT

A down hole cleaning assembly is connected to a work string concentrically located within a casing string. In one embodiment, the down hole assembly comprises a mandrel operatively connected to the work string, with the mandrel having an opening therein. A pad member is received within the opening, with the pad member having a groove formed therein. Also provided is a wire brush member, operatively positioned within the groove of the pad member, for cleaning the internal diameter of the casing string. The down hole assembly further comprises a biasing member, operatively positioned between the mandrel and the pad member, adapted for biasing the wire brush against the inner diameter of the well bore. In the preferred embodiment, the wire brush includes a wire bundle, a brace disposed about the second end of the wire bundle, and wherein the brace is disposed within the groove of the pad member. The brace herein disclosed includes an open end and a closed end, with the closed end having disposed therein the second end of the wire bundle, and wherein the open end and the closed end cooperate to form a triangular shaped profile. The groove will also contain a triangular shaped profile adapted to slidably receive the triangular brace.

15 Claims, 8 Drawing Sheets

DOWN HOLE CLEANING DEVICE AND METHOD

BACKGROUND OF THE INVENTION

This invention relates to a down hole assembly used to clean tubular strings. More particularly, but not by way of limitation, this invention relates to an apparatus and method for cleaning the internal diameter of casing strings with a bristle brush circumferentially arranged about a down hole assembly.

In the development of oil and gas fields, operators will drill a well to a hydrocarbon reservoir, and thereafter, run a casing string through the production formation. The casing string will then be cemented into place. In turn, the well will then be completed as is well appreciated by those of ordinary skill in the art.

The optimization of production is an important criteria of any completion. Studies have shown that residue on the internal diameter of the casing string (such as cement, pipe dope, scale, burrs, etcetera) have a negative impact on productivity. Specialized completion fluids devoid of fines, solids and other debris are used to complete the well. Therefore, a major emphasis has been made to clean the inner diameter of the casing string.

Thus, when the operators have finished the pumping of a cement composition through the well casing, a work string is lowered on which a mechanical scraping device is used to scrap the walls of the casing. In the prior art, various types of casing scrapers are in use prior to displacement of a clean completion fluid. That is why it is so important to clean the casing wall as much as possible since it takes less time to ultimately filter the displaced completion fluids. Also, cleaning will eliminate foreign matter such as cement sheaths, scale, burrs and barite which in turn allows the tools used in the completion process to properly perform.

The scraping action of traditional scrapers with blades also have been known to leave a fine film of oil base or synthetic fluid residue on the casing wall. Prior art devices also cause problems because of the hardness of their blades cannot get into the casing connections as brushes can. Also, casing scrapers in high deviated holes collapse to the low side of the casing causing a great deal of wear on one side and the top side of the hole is not properly cleaning the high side due to ineffective engagement with the high side.

Therefore, there is a need for a down hole assembly that will be effective in cleaning a well bore that contains an oil base and/or synthetic fluid. There is also a need for a cleaning apparatus that will be effective in highly deviated wells. There is also a need for a down hole assembly that will have scraper brushes that are of sturdy construction and allow for ease of replacement.

SUMMARY OF THE INVENTION

A down hole cleaning assembly is disclosed. Generally, the down hole assembly is connected to a work string concentrically located within a casing string. In one embodiment, the down hole assembly comprises a mandrel operatively connected to the work string, with the mandrel having an opening therein. A pad member is received within the opening, with the pad member having a groove formed therein. Also provided is a wire brush means, operatively positioned within the groove of the pad member, for cleaning the internal diameter of the casing string.

The down hole assembly further comprises a biasing member, operatively positioned between the mandrel and the pad member, adapted for biasing the wire brush means against the inner diameter of the well bore. In the preferred embodiment, the wire brush means comprises a wire bundle having a first end and a second end, a brace disposed about the second end of the wire bundle, and wherein the brace is disposed within the groove of the pad member.

The brace herein disclosed includes an open end and a closed end, with the closed end having disposed therein the second end of the wire bundle, and wherein the open end and the closed end cooperate to form a triangular shaped profile. The groove will also contain a triangular shaped profile adapted to slidably receive the triangular brace.

In the preferred embodiment, the mandrel contains a second of slot, and wherein the down hole assembly further comprises a second pad member adapted to be received within the second slot, the second pad containing a second groove formed therein. A second wire brush means, operatively positioned within the second groove of the pad member, is also provided for cleaning the internal diameter of the casing string.

The down hole assembly may also contain a centralizer means, operatively adapted to the work string, for centralizing the mandrel within the casing string. A dove tail means, operatively associated with the mandrel, is also included for selectively adapting the wire brush means onto the work string.

In the preferred embodiment, the first and second wire brush means are arcuate, and wherein said first wire brush means is disposed about the periphery of the mandrel to cover a first 180 degree phase and wherein the second wire brush means is disposed about the periphery of the mandrel to cover a second 180 degree phase so that the first wire brush means and the second wire brush means cover a 360 degree phase about the mandrel. In another embodiment, a plurality of wire brush means may be placed about the periphery of the mandrel, with the wire brush means being staggered circumferentially in relation to each other so that the wire brushes have an effective coverage area of 360 degrees.

Also disclosed herein is a method of cleaning a casing string. The method comprises lowering a work string within the casing string. The work string will have provided therewith a down hole cleaning apparatus operatively associated with the work string. The wire bundle of the cleaning apparatus will be urged against the inner diameter of the casing string via the spring to allow for constant pressure of the brushes against the casing wall at all times. The method provides for cleaning the inner diameter of the casing string as the work string is lowered.

The method further comprising rotating the work string, and thereafter, lowering the work string. The operator may then circulate a drilling fluid through the inner diameter of the work string. The work string may be stationary or rotating during circulation.

In one embodiment, the well casing has a horizontal section so that a low side of the well casing and a high side of the well casing is created. In this embodiment, the apparatus includes a centralizer operatively associated with the work string. Also included will be a second cleaning apparatus, with the first cleaning apparatus covering a 180 degree phase and the second cleaning apparatus covering a complimentary 180 degree phase so that the entire 360 degree periphery is covered.

The method would further comprise lifting the apparatus from the low side of the inner diameter of the well casing with the centralizer. Also, the wire bundle of the first cleaning apparatus is urged against the low side of the inner diameter of the well casing with the spring at a constant force. Simultaneously therewith, the wire bundle of the second cleaning apparatus is urged against the high side of the inner diameter of the well casing with its spring at a constant force so that both the low side of the casing and the high side of the casing will be cleaned.

An advantage of the present invention includes the ability to thoroughly clean the internal diameter of the casing of a coarse material such as cement while at the same time being able to scour the casing of thin films left by oil base and synthetic muds that contain hydrocarbons. Another advantage includes that the design allows easy replacement of the components so that if a brush becomes worn, a new brush may be easily inserted therein at the rig location.

Another advantage includes use of wire bristles that are of sufficient hardness to allow for the scraping of the inner diameter of the casing. Yet another advantage includes a staggered configuration of the brushes that allows for the entire 360 degree periphery of the casing to be cleaned. Still yet another feature is that the device may be used in highly deviated and/or horizontal wells.

A feature of the present invention includes a novel locking mechanism brace that allows the clamping of a bundle of wire bristles. Another feature is that the novel locking mechanism includes triangular grooves formed within the pad that cooperate with a triangular brace profile fitted therein. Yet another feature is the dove tail locking means for selectively locking the pad onto the mandrel.

Another feature includes a spring loaded pad that urges the wire brush against the wall of the casing at a constant pressure. Thus, in a highly deviated well, both the high side and low side of the well will be cleaned. Still yet another feature is use of a centralizer that allows for the wire brush to be centered within well. This feature keeps both brushes centralized which in turn keeps the same pressure about the circumference of the casing walls.

DETAILED DESCRIPTION OF THE PREFERRED EMBODIMENTS

Figure 1:
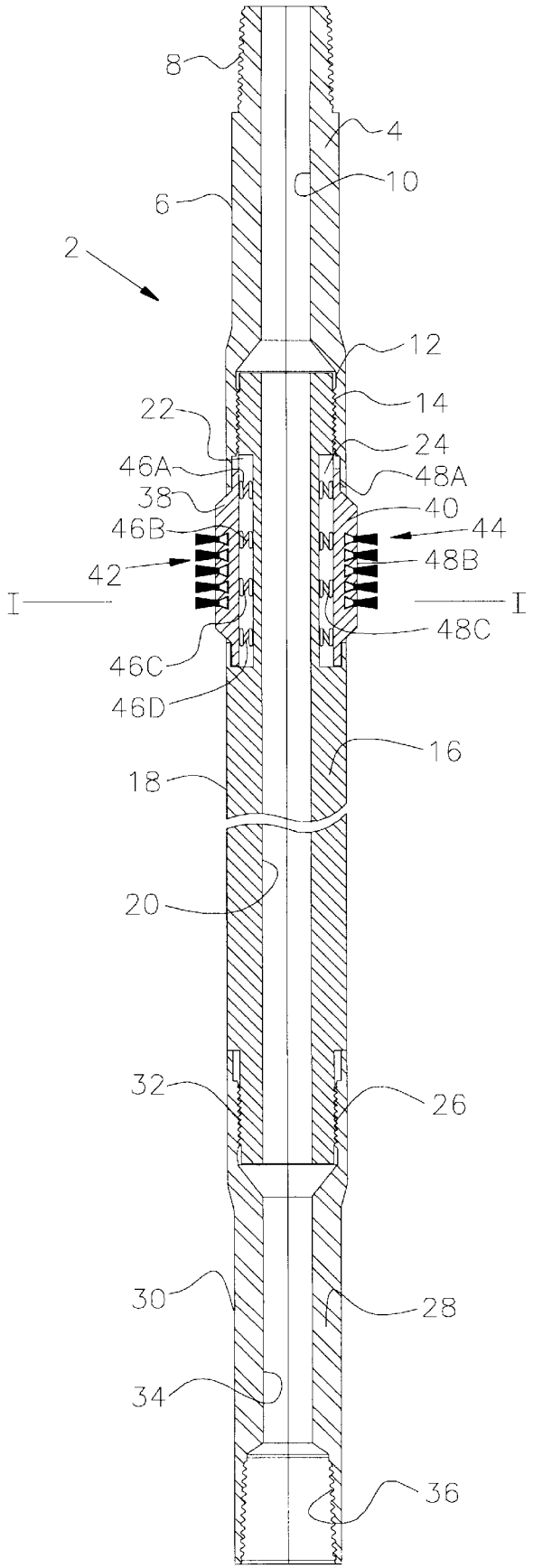
FIG. 1 is a cross-sectional view of the down hole cleaning assembly shown in a first phase.

Referring now to FIG. 1, a cross-sectional view of the down hole cleaning assembly 2 shown in a first phase will now be described. Generally, the assembly 2 includes a first mandrel 4 that has an outer diameter surface 6 that includes an external thread profile 8. The external thread profile 8 may be attached to a work string (not shown) such as drill pipe. It should be understood that other types of work strings are available such as snubbing pipe, coiled tubing, production strings, etc. The first mandrel 4 will have a first internal bore 10 that extends to the second internal bore 12 that will have contained thereon internal thread means 14.

The assembly 2 contains a second mandrel 16 having an outer diameter 18 and an inner bore 20. The outer diameter 18 will have a series of openings formed therein, with FIG. 1 showing opening 22 and opening 24. It should be noted that in the preferred embodiment, there will be two rows of openings, with the first row along line I—I of FIG. 1 and the second row along line II—II of FIG. 6. Each row will contain three openings.

The outer diameter 18 may contain other openings that will be described later in the application. The outer diameter 18 will also contain the external thread means 26. In the embodiment shown in FIG. 1, the second mandrel 16 is made up to a third mandrel 28. The third mandrel 28 will have an outer diameter 30 that in turn extends radially inward to the internal threads 32 which in turn extends to the inner bore 34 that in turn leads to the internal threads 36. The third mandrel 28 may be attached to another down hole tool such as a bit.

The assembly 2 will have included the pad members 38, 40 that are operatively positioned within the openings 22, 24 respectively. The pad members 38, 40 will have a plurality of grooves formed therein with the grooves containing wire brush means 42, 44 for cleaning the internal diameter of a casing string. The wire brush means 42, 44 is generally a wire bristle arrangement that is commercially available from Spiral Brush, Inc. under the name steel wire. The bristles are manufactured from carbon or stainless steel.

The pad members 38 are operatively associated with biasing means 46, 48 for urging the pads 38, 40 (and in turn the wire brush means 42, 44) outerwardly with respect to the casing. In the preferred embodiment, each opening will have three springs, namely, a first spring 46A/48A, second spring 46B/48B, and third spring 46C/48C. The spring loaded pads will allow for constant pressure of the brushes against the casing wall at all times. It should be noted that additional springs may be employed, for instance, when the device used has a large diameter so that more force is needed to adequately bias the pads.

The invention may have a plurality of openings within the outer diameter 18 for placement of additional pad and wire brush means as previously set out. With a staggered configuration of pads about the body of the mandrel 16, a 360 degree circumference about the inner diameter of the casing may be cleaned. This will be further explanation in reference to FIG. 6.

Figure 2:
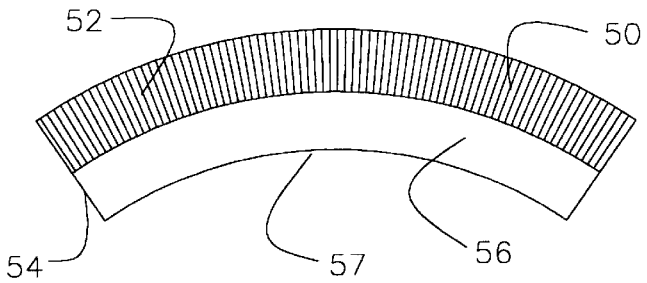
FIG. 2 is a top view of the wire brush member of the preferred embodiment of the present invention.

Referring now to FIG. 2, a top view of the wire brush member 42, 44 of the present invention will now be described in greater detail. The wire brush member 42, 44 includes a bundle of wires that can be purchased from Spiral Brush. The bundle of wires may be comprised of a carbon or stainless steel material. As depicted in FIG. 2, the bundle of wires 50 will have a first end 52 and a second end 54. The linear bundle of wires 50 is wrapped about a center rod 55. The second end 54 will be encapsulated within a brace 56, with the brace 56 tightly clamping about the second end 54 and rod 55 so that the wires are held together. Further, the brace 56 is arcuate with respect to radial surface 57 and has generally the same radius of curvature as that of the mandrel 16.

Figure 3A:
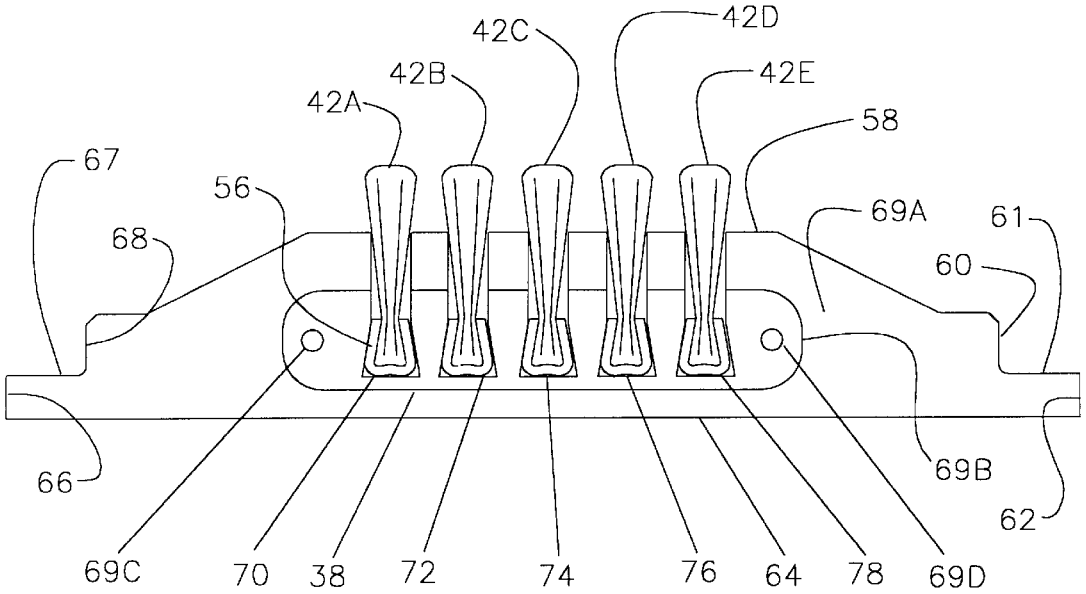
FIG. 3A is an end view of the pad member with wire brush member inserted therein of the preferred embodiment.

In reference to FIG. 3A, an end view of the pad member 38 with wire brush means 42 inserted therein is shown. In the preferred embodiment, the pad member 38 contains an outer surface 58 that slopes to first shoulder 60 that in turn extends to a surface 61 and then to a second shoulder 62. The second shoulder 62 advances to the internal surface 64 that in turn extends to a third shoulder 66 and surface 67 which in turn stretches to the fourth shoulder 68. The outer surface 58 will contain a series of grooves 70, 72, 74, 76, 78 that are formed in the pad 38 so that series of triangular profiles are formed therein. Thus, the braces 56 may be laterally placed therein.

Figure 3B:
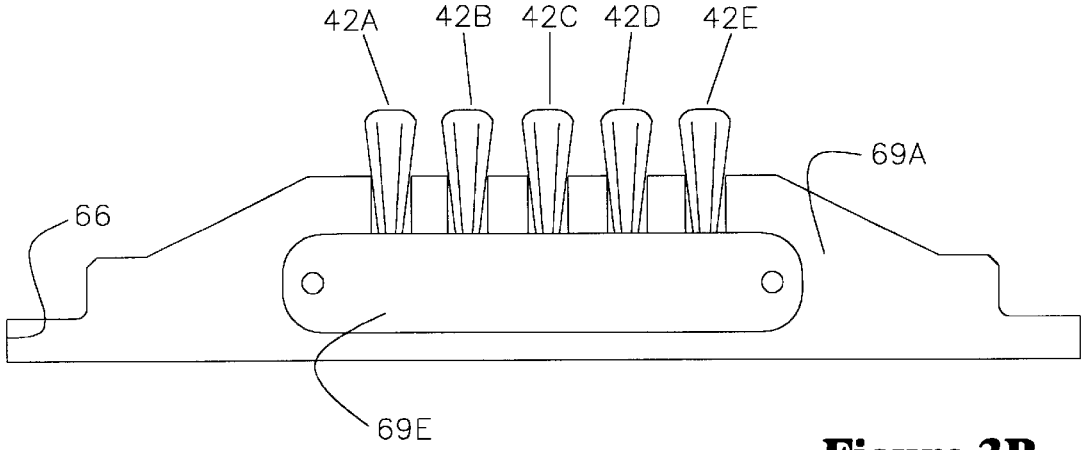
FIG. 3B is an illustration of FIG. 3A with the end plate inserted thereon.

Also, the present invention teaches having a groove 69B formed within the end face 69A. The end face 69A will have two openings 69C & 69D that will receive an attachment means such as a set screw. In FIG. 3B, the illustration of FIG. 3A is depicted with an end plate 69E operatively associated therewith. Thus, the end plate 69E will be inserted within the groove 69B, and will further have a pair of set screws that are inserted into the openings 69C & 69D. With the end plate in place, the wire brush means 42 are effectively locked into position so that they can not inadvertently back-out during operation. An end plate may be placed on all of the pad members.

Figure 4:
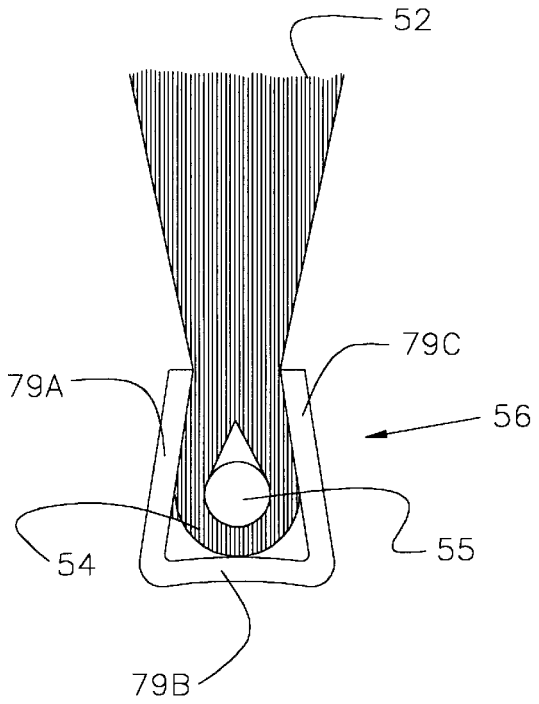
FIG. 4 is a side view detail of the wire brush member clamped with the brace member of the preferred embodiment.

With reference to FIG. 4, a side view detail of the wire brush means 42,44 clamped with the brace member 56 of the present invention will now be described. The brace 56 may comprise a first leg 79A, a second leg 79B, and a third leg 79C, with the legs 79A, 79C bent in relation to each other so that a triangular profile is formed as well as clamping the second end 54 of the wire bundle. As stated earlier, the wire bundle will generally have a first end 52 that will serve to clean the casing. As shown, the clamping effect of the brace 56 causes the wire end 52 to expand which enhances the effectiveness of the wire scraping the casing wall as well as serving to clutch the wire bundle and rod 55 in place.

Figure 5:
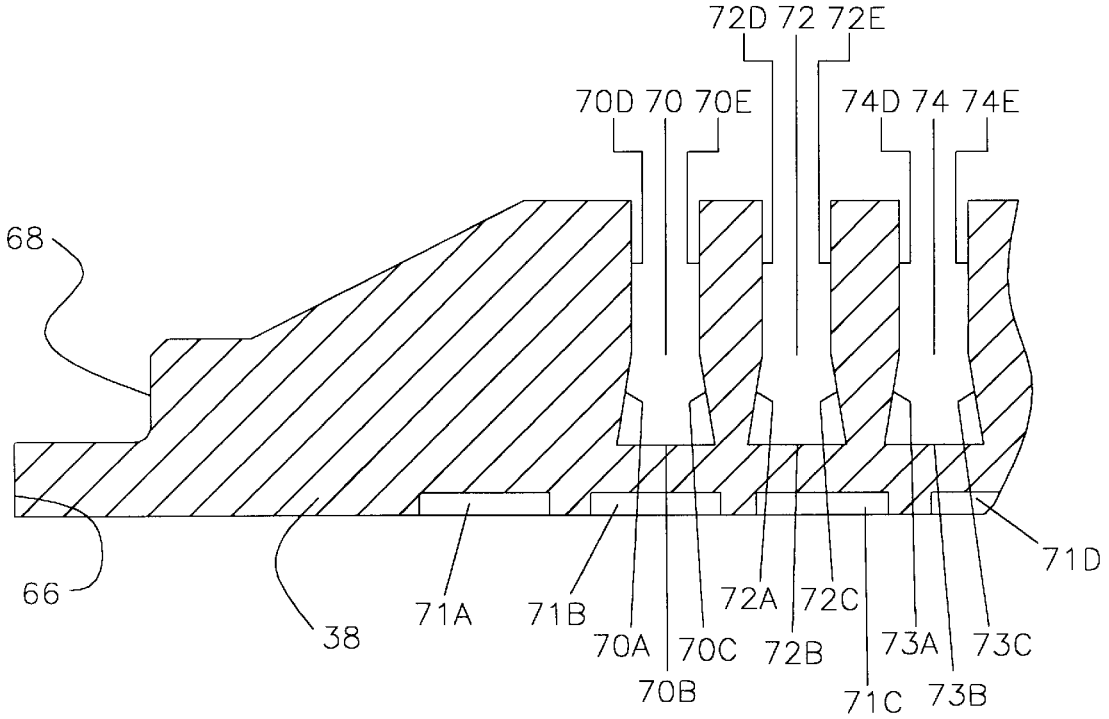
FIG. 5 is a side view detail of the pad member of FIG. 3.

In reference to FIG. 5, a side view detail of the pad member 38 of FIG. 3 is shown. It should be noted that like numbers appearing in the various figures correspond to like components. Thus, the pad member 38 will have a series of grooves 70, 72, 74, 76, 78. The individual grooves will have a first wall 70A, a second wall 70B and a third wall 70C, with the three walls forming a triangular profile that is essentially patterned after the brace 56 so that the brace 56 may be slidably disposed therein. The triangular shaped profile allows for lateral placement of the brace 56 therein while at the same time securing the brace 56 from radial release from the grooves 70–78. The grooves 70–78 may also contain radial surfaces 70D, 70E, 72D, 72E, 74D and 74E.

FIG. 5 also depicts the channels 71A–D that may be included which receive and cooperate with the springs. Although not shown, the series of rows may be arranged in an inclined orientation relative to the axial bore which gives the series of rows a spiral effect. The inclined orientation allows for the displacement of the particles and compounds that are on the wall of the casing to be more easily channeled as the device is either being lowered into the well, raised from the well, or being rotated in the well. The embodiment of FIG. 5 may also include an end plate member that contains two openings for placement of set screws to affix the plate member onto the pad. The plate member will hold the brushes in place and prevent the brushes from sliding out of the grooves.

Figure 6:
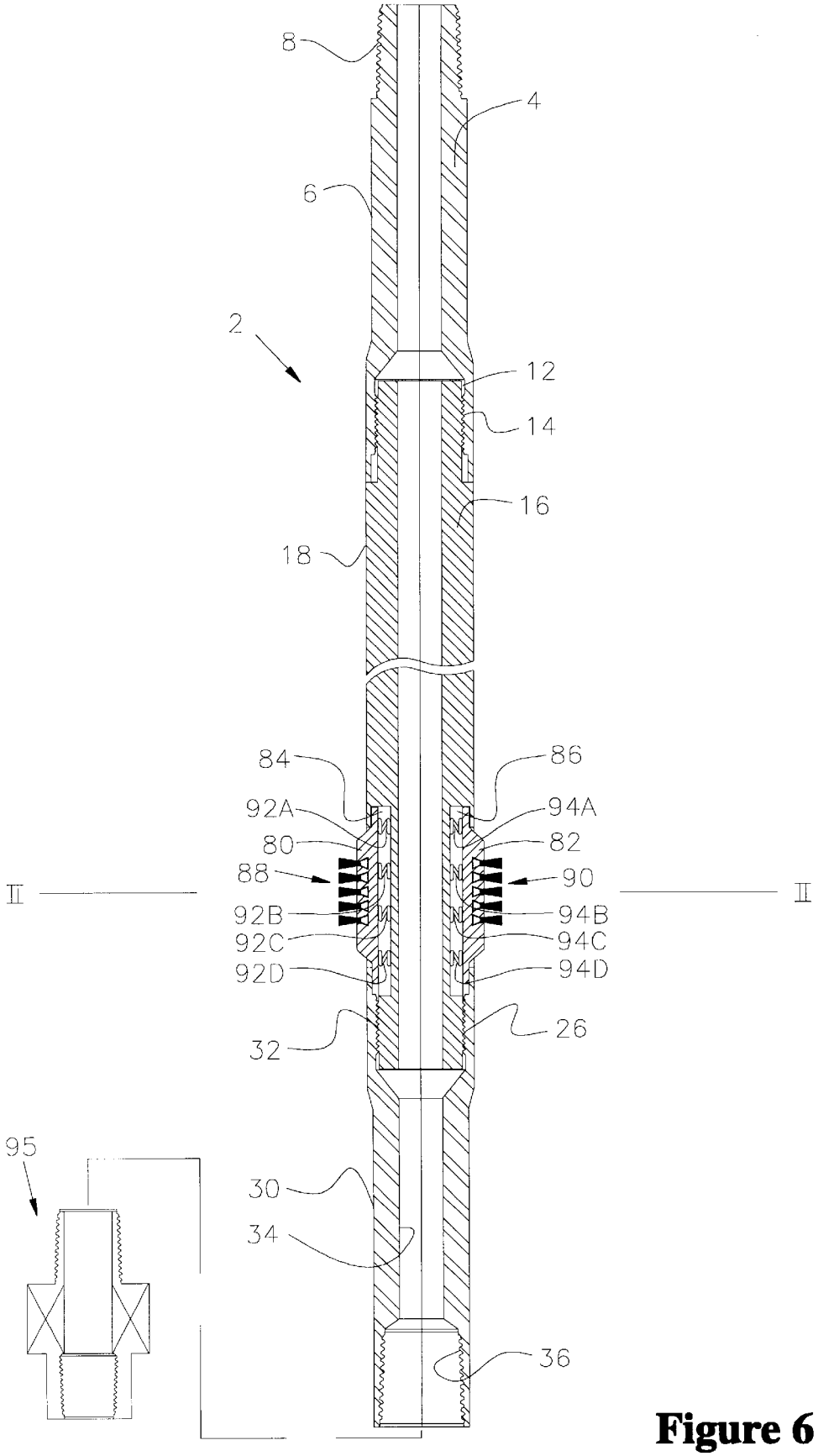
FIG. 6 is a cross-sectional view of the down hole cleaning assembly shown rotated to a second phase.

Referring now to FIG. 6, a cross-sectional view of the down hole cleaning assembly 2 shown rotated to a second phase will now be described. Thus, the drawing shows the second row including the pad member 80 and pad member 82 that will be inserted within the openings 84, 86. The pad members 76, 78 will have associated therewith the wire brush means 88 and 90, respectively for cleaning the internal diameter of the casing string. As set out earlier, the wire brush means 84, 86 will include the wire bundles clamped via a brace.

The pad member 76 will be urged outward toward the casing inner wall via the springs 92A, 92B, 92C and the pad member 78 will be urged outward toward the casing inner wall via springs 94A, 94B, 94C. As previously set forth, the springs 92A–C and 94A–C will urge the wire brush against the wall of the casing at a constant force. Thus, if the work string is being lowered through dog legs, or other highly deviated portions of the well, the springs will allow the retraction or urging as is necessary. The centralizer means 95, which is operatively associated with the work string, is included for centralizing the mandrel 16 within the casing string. The centralizer means 95 is threadly attached to the assembly 2 via thread means 36. Although not shown, another centralizer may be added to the mandrel 14.

Figure 7:
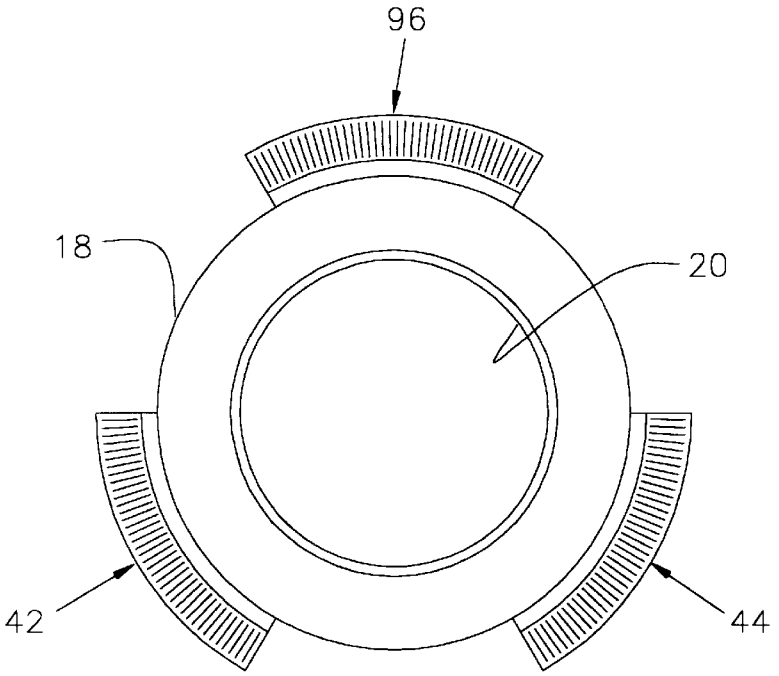
FIG. 7 is a cross-sectional view of line I—I taken from FIG. 1.

The illustration of FIG. 7 depicts a cross-sectional view of line A—A taken from FIG. 1. Thus, the brush means 42 and 44 are shown along with the brush means 96 in a first row. It should be noted that while three brush means 92 are shown in FIG. 7, the actual number may vary depending on numerous variables such as hole size, work string, etc. The brush means 92 will be included within an opening along with the pad and spring as previously described. The three brush means will provide for an effective cleaning area of 180 degrees.

Figure 8:
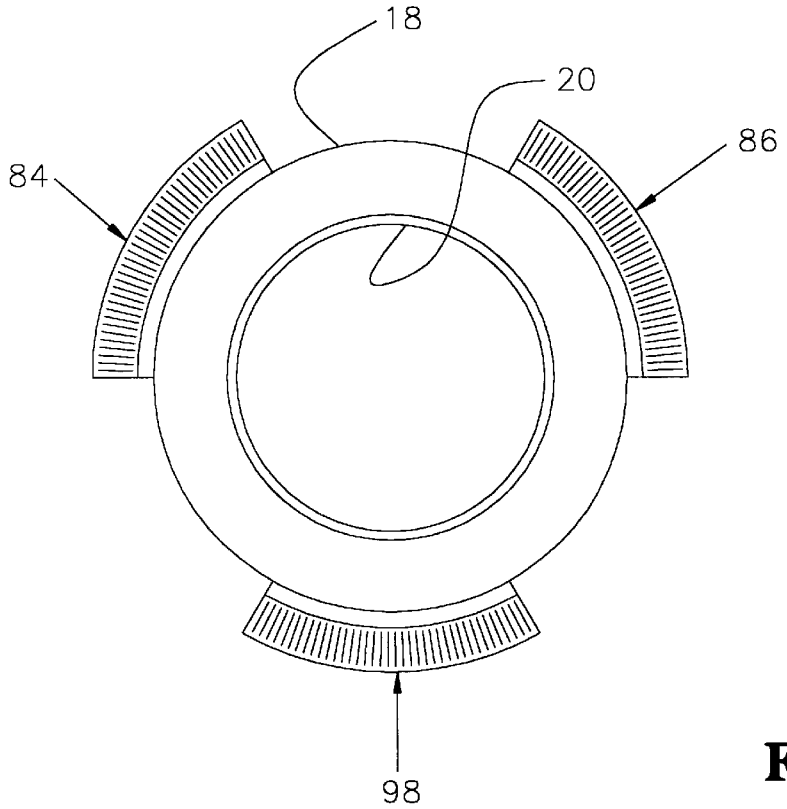
FIG. 8 is a cross-sectional view of line II—II taken from FIG. 6.

In FIG. 8, the drawing illustrates a cross-sectional view of line B—B taken from FIG. 6 wherein FIG. 6 depicts three brush means, namely 84, 86 and 98 in a second row. The construction of the pads, openings, springs and brush means is similar to those described in FIGS. 1 through 7. The three brush means will provide for an effective cleaning area of 180 degrees. As seen in FIG. 8, the brush means 84, 86, 98 are disposed in a different phase when compared to the brush means 42, 44, 96 so that a staggered 360 degree coverage of the inner diameter may be accomplished during an operational trip into the casing string i.e. the entire inner diameter circumference will be cleaned.

Figure 9:
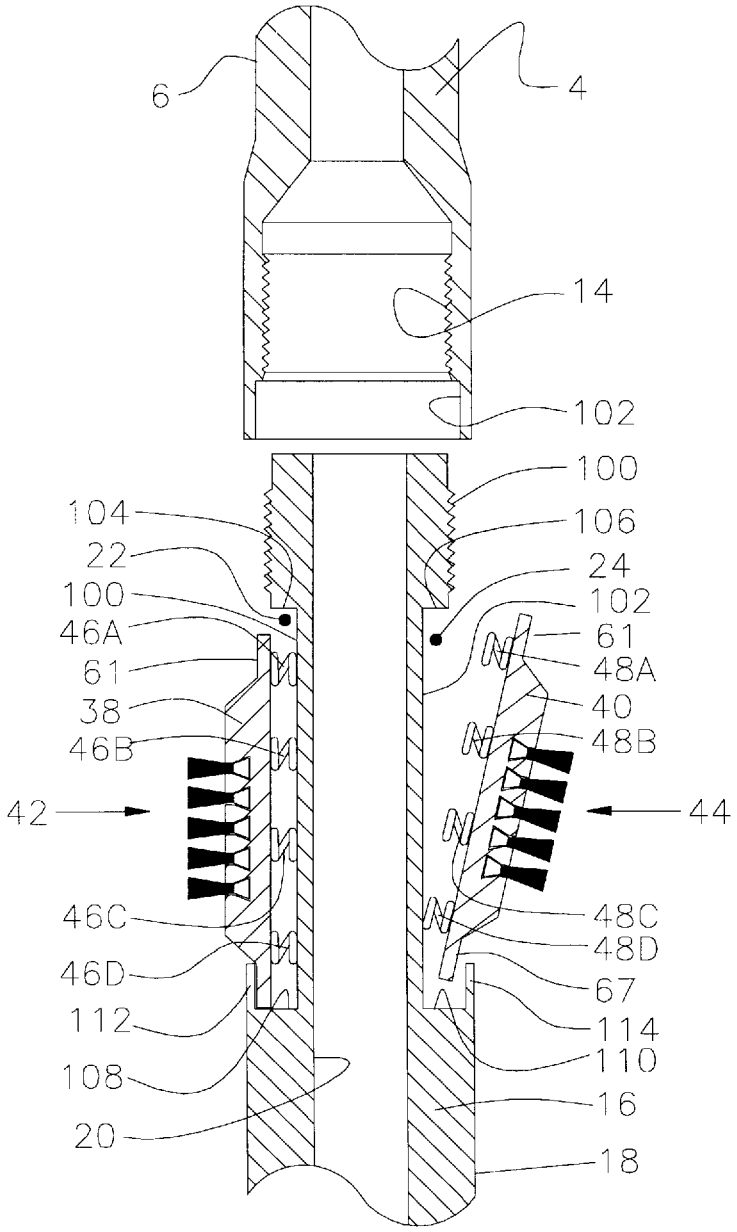
FIG. 9 is a cross-sectional view of an embodiment of the present invention that depicts dove tail means for attaching the pads to the down hole cleaning assembly.

FIG. 9 is a cross-sectional view of an embodiment of the present invention that depicts dove tail means for attaching the pads to the down hole cleaning assembly 2. More particularly, the first mandrel 4 will have the internal threads 14 that cooperate with the external threads 100 of the second mandrel 16. The internal threads 14 lead to a inner bore surface 102.

The external threads 96 extend to the openings 22, 24 that have radial shoulders 104, 106. The openings 22, 24 are generally slots that are formed on the periphery of the mandrel 16 and are adapted to receive the pads 38, 40 as previously described. The slots formed will terminate at the shoulders 108, 110 that in turn extends to the lip 112, 114.

The lips 112, 114 then lead to the outer diameter surface 18. It should be noted that while two openings 22, 24 are shown in FIG. 9, the preferred embodiment will contain three staggered openings about the periphery as shown in FIG. 7.

Therefore, when the tool is to be assembled, the operator may place the springs 46A–46C and 48A–46C within the openings 22, 24. The pads 38, 40 are then placed within the openings 22, 24 The surface 67 of the pad member 40 is placed within the opening 24 such that the surface 67 and lip 114 abut each other and with the pads 38, 40 up against the shoulder 104 and 106. Next, the first mandrel 4 is threadedly connected with the second mandrel 16 by making up threads 14 with threads 96. The inner bore surface 97 will slide-over the lip 61. With the lip 61 in place, the inner bore surface 97 will hold the pads 38, 40 so that the pads may be biased radially outwardly via springs 46A–46C and 48A–48C. Meanwhile, the surface 67 will engage the lip 108, 110 so that the pad members 38, 40 are held in position.

Thus, the individual pad members may be replaced on location by threadedly removing the mandrel 4, withdrawing the old pad member, and thereafter placing a new pad member with new brush means thereon into the openings. Next, the operator could then threadedly make up the mandrel 4 onto mandrel 16 as previously set forth.

Also, the mandrel 28 will have similar thread means with an inner bore surface for making up to the mandrel 16 so that the second series of pad members 76, 78 may be similarly dove tailed for selectively adapting said pad members 76, 78 with the mandrels 16, 28.

Figure 10:
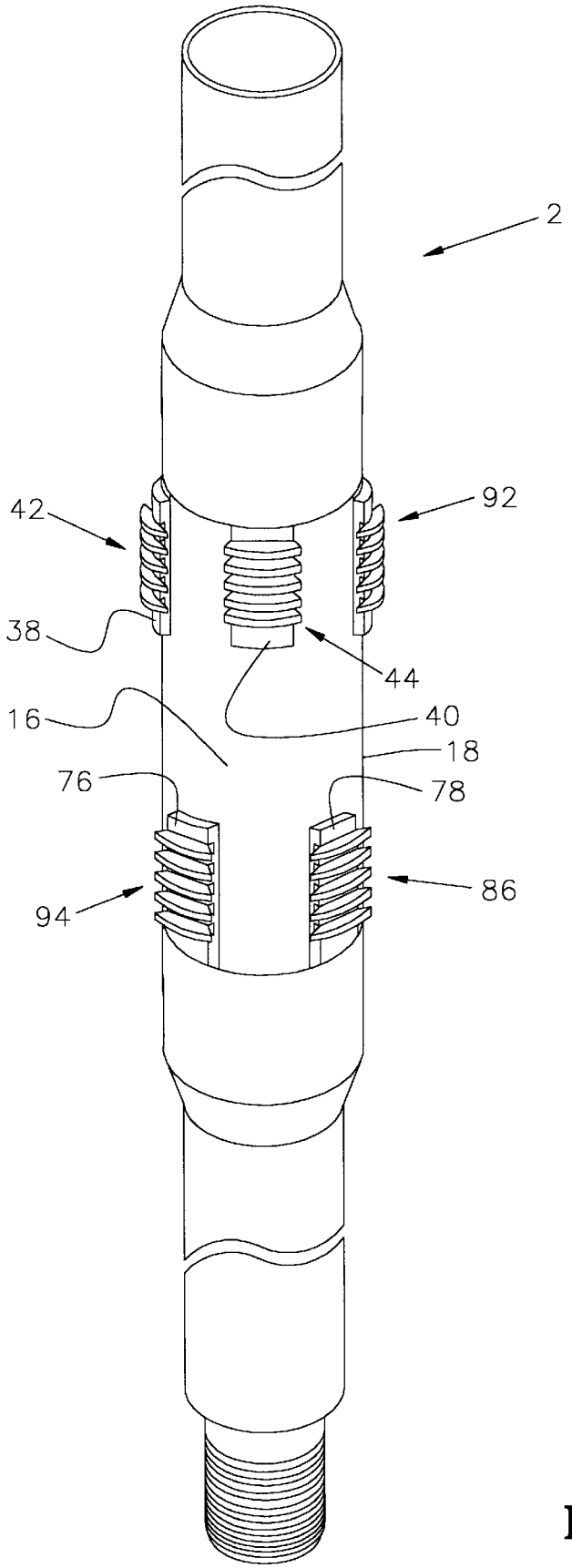
FIG. 10 is a perspective view of the down hole cleaning assembly of the preferred embodiment of the present invention.

The invention is illustrated in a perspective view in FIG. 10. Thus, in the preferred embodiment, the brush means 42, 44, 92 are positioned in a first row while the brush means 84, 86, 94 are positioned in a second row. Also, the FIG. 10 depicts the pads 38, 40, 76, 78 disposed within openings contained on the mandrel 16 as previously described.

Figure 11:
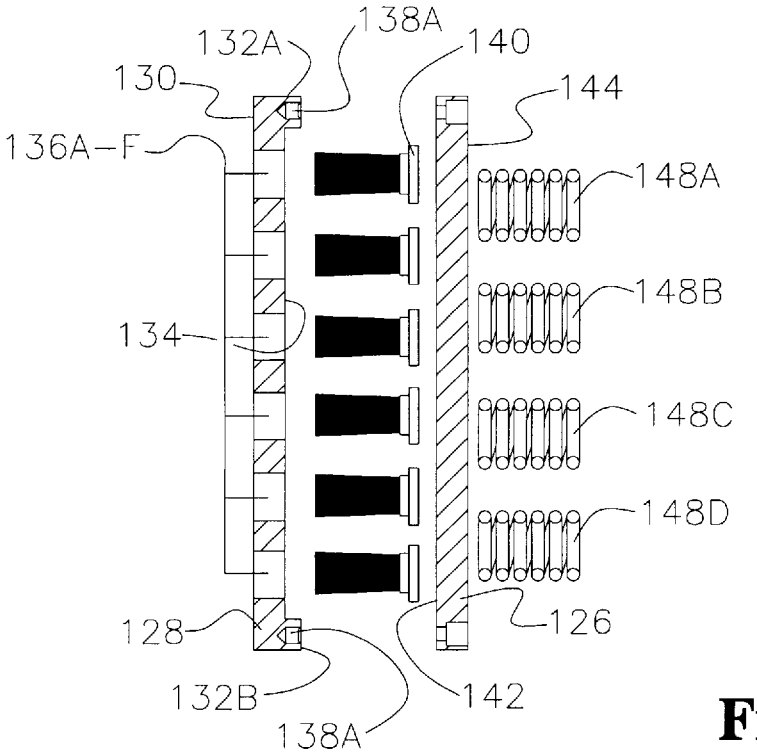
FIG. 11 is a disassembled cross-sectional view of a second embodiment of the pad and wire brush member.

There is yet another embodiment possible with the teachings of the present invention. Referring now to FIG. 11, the embodiment includes a different type of wire brush means 122 operatively associated with the pad member 124. The pad member 124 includes the first plate 126 and the second plate 128 which allows for the back side placement of the brush means 122 through the second plate 128.

The pad member 124 of FIG. 11 will be received within the openings 22, 24, 84, 86 etc. previously mentioned. The plates 126, 128 are arcuate so that they fit into the contour of the outer diameter of the mandrel 16. The second plate 128 will have an outer surface 130 that extends to the ledges 132A–B which in turn extends to the inner surface 134. The second plate 128 has disposed therein the openings 136A–F and the ledge 132 has openings 138A–B.

Also depicted in FIG. 11 is the wire brush means 122 for cleaning the internal diameter of said casing string as previously described. The wire brush means 122 is also commercially available from Spiral Brush Inc. In this embodiment, the individual wire brush means 122 are disposed through the openings 136A–F and are generally circular arranged about a base 140. The base 140 is of a diameter greater than the diameter of the opening 136 so that the wire brush means 122 can not pass therethrough.

The first plate 126 contains the first surface 142 that stretches to a second surface 144. The second surface 144 will have disposed therein openings 146A, 146B. A fastener, such as a screw, may be placed therethrough and be operatively attached with the second plate 128 via the openings 138A, 138B. In this manner, the wire brush means 122 will fit through the openings and once the plates 126 and 128 are fastened together, the wire brush means 122 are locked into position.

Figure 12:
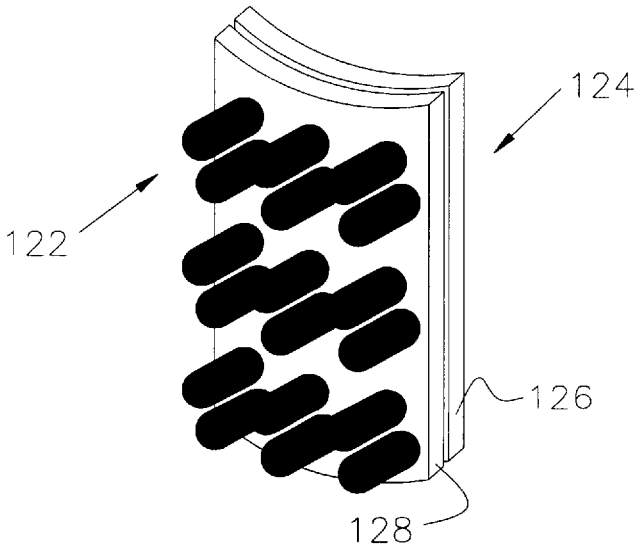
FIG. 12 is a perspective view of the pad and wire brush member of FIG. 11.

The spring means 148A–D will be positioned so that one end of the spring is up against the surface 144 while the other end is against the surface 102, for instance. Thus, the spring means 148A–148D will bias the pad member 124 axially outward into engagement with the wall of the casing string as previously set forth. FIG. 12 is a perspective view of the pad 124 and wire brush member 122 of FIG. 11 assembled.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

I claim:

1. A down hole assembly for use in a well bore on a work string concentrically located within a casing string, said down hole assembly comprising:

a mandrel operatively connected to the work string, said mandrel having an opening therein;

pad member received within said opening, said pad member having a groove formed therein;

a wire brush means, operatively positioned within said groove of said pad member, for cleaning the internal diameter of said casing string and wherein said wire brush means comprises; a wire bundle having a first end and a second end; a brace disposed about said second end of said wire bundle; and wherein said brace is disposed within said groove of said pad member;

a biasing member, operatively positioned between said mandrel and said pad member, adapted for biasing said wire brush means against the inner diameter of said well bore.

2. The down hole assembly of claim 1 wherein said brace comprises:

an open end and a closed end, with the closed end having disposed therein said second end of said wire bundle, said brace having an open end and a closed end, and wherein said open end and said closed end cooperate to form a triangular shaped profile.

3. The down hole assembly of claim 2 wherein said groove has an angular shaped profile adapted to slidably receive said triangular shaped portion of said brace.

4. The down hole assembly of claim 3 wherein said mandrel contains a second of opening, and wherein the down hole assembly further comprises:

a second pad member adapted to be received within said second opening, said second pad containing a second groove formed therein;

a second wire brush means, operatively positioned within said second groove of said pad member, for cleaning the internal diameter of said casing string.

5. The down hole assembly of claim 4 further comprising:

a centralizer means, operatively adapted to said work string, for centralizing the mandrel within said casing string.

6. The down hole assembly of claim 5 wherein said first wire brush means and said second wire brush means are arcuate, and wherein said first wire brush means is disposed about the periphery of said mandrel to cover a first 180 degree phase and wherein said second wire brush means is disposed about the periphery of said mandrel to cover a second 180 degree phase so that said first wire brush means and said second wire brush means cover of a 360 degree phase about said mandrel.

7. The down hole assembly of claim 6 further comprising:

dove tail means, operatively associated with said mandrel, for selectively adapting said pad member with said mandrel.

8. A method of cleaning a casing string, said casing string having an inner diameter, the method comprising:

lowering a work string within said inner diameter of said casing string;

providing a cleaning apparatus operatively associated with said work string, said apparatus comprising: a mandrel operatively connected to the tubing string, said mandrel having an opening therein; a pad member received within said opening, said pad member having a wedged shaped groove formed therein; a wire bundle having a first end and a second end; a brace disposed about said second end of said wire bundle, said brace having an open end and a closed end, with the closed end having disposed therein said second end of said wire bundle, and wherein said open end and said closed end cooperate to form a wedged shaped profile; and wherein said brace is disposed within said wedged shaped groove of said pad member; a spring, operatively positioned between said mandrel and said pad member, adapted for biasing said wire bundle against the inner diameter of the casing string;

urging said wire bundle against the inner diameter of said casing string with said spring;

cleaning the inner diameter of said casing string.

9. The method of claim 8 further comprising:

rotating the work string;

lowering the work string;

circulating a drilling fluid through the inner diameter of the work string.

10. The method of claim 8 wherein said well casing has a horizontal section so that a low side of the well casing and a high side is created, and the apparatus further comprises a centralizer operatively associated with said work string and a second cleaning apparatus, with the first cleaning apparatus covering a 180 degree phase and the second cleaning apparatus covering an complimentary 180 degree phase, and wherein the method further comprises:

lifting the apparatus from the low side of the inner diameter of the well casing with said centralizer;

urging said wire bundle of the first cleaning apparatus against the low side of the inner diameter of the well casing with said spring at a constant force;

urging said wire bundle of the second cleaning apparatus against the high side of the inner diameter of the well casing with said spring at the constant force.

11. An apparatus for cleaning a well bore, said well bore containing an inner diameter, the apparatus comprising:

a first wire bundle having a first end and a second end;

a first brace disposed about said second end of said wire bundle, and wherein said first brace comprises an open end and a closed end, with the closed end having disposed therein said second end of said first wire bundle, and wherein said open end and said closed end cooperate to form a wedged shaped profile;

a first pad member having a groove formed therein, said groove being adapted to receive said first brace, and wherein said groove has an angular shaped profile adapted to slidably receive said first brace.

12. The apparatus of claim 11 further comprising:

a tubular mandrel having an internal diameter and an external diameter, and wherein said external diameter has disposed therein a slot, and wherein said first pad member is received therein.

13. The apparatus of claim 12 further comprising a stabilizer means, adapted to attach with said mandrel, for stabilizing said mandrel within said well.

14. The apparatus of claim 13 further comprising a spring, said spring being adapted between said mandrel and said pad, said spring adapted to urge said pad in a first direction so that said wire brush contacts said inner diameter of said well.

15. The apparatus of claim 14 wherein said tubular mandrel has a second slot, and the apparatus further comprises:

a second wire bundle having a first end and a second end;

a second brace disposed about said second end of said wire bundle, and wherein said second brace contains an open end and a closed end, with the closed end having disposed therein said second end of said second wire bundle, said clapping member having an open end and a closed end, and wherein said open end and said closed cooperate to form a wedged shaped profile.;

a second pad member adapted to be received within said second slot, said second pad having an angular shaped profile groove formed therein, said angular groove being adapted to receive said wedge of said second brace; and and wherein said first pad and said second pad are staggered circumferentially so that first and second wire bundles have an effective area of 360 degrees about said mandrel.

* * * * *